US011767804B1

(12) United States Patent
Choudhary et al.

(10) Patent No.: US 11,767,804 B1
(45) Date of Patent: Sep. 26, 2023

(54) CAST ENGINE BLOCK HAVING A HYBRID THREADED INSERT

(71) Applicant: GM Global Technology Operations LLC, Detroit, MI (US)

(72) Inventors: Lokesh Choudhary, Bangalore (IN); Qigui Wang, Rochester Hills, MI (US); Brian D Kaminski, Lake Orion, MI (US); Gregory Melekian, Clarkston, MI (US); Ronald C. Daul, Northville, MI (US); Kurt T. Hilvers, Fremont, IN (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 18/161,516

(22) Filed: Jan. 30, 2023

(51) Int. Cl.
*F02F 1/00* (2006.01)
*F02F 1/18* (2006.01)
*F02F 7/00* (2006.01)

(52) U.S. Cl.
CPC ..... *F02F 1/18* (2013.01); *F02F 7/0085* (2013.01)

(58) Field of Classification Search
CPC ..... F16B 37/00; F16B 37/122; F16B 37/125; F16B 13/066; F02F 2007/0041; B23B 41/12
USPC ..... 123/193.2
See application file for complete search history.

(56) References Cited

U.S. PATENT DOCUMENTS

| | | | | |
|---|---|---|---|---|
| 3,566,947 | A * | 3/1971 | Jukes | F16B 37/122 29/523 |
| 4,325,665 | A * | 4/1982 | Jukes | F16B 37/125 411/176 |
| 7,985,040 | B2 * | 7/2011 | Cao | F16B 35/041 411/397 |
| 11,181,335 | B1 * | 11/2021 | McPherson | F41B 5/148 |
| 2003/0190213 | A1 * | 10/2003 | Lutkus | F16B 37/12 411/178 |
| 2022/0205471 | A1 * | 6/2022 | Flowers | F16B 39/34 |
| 2023/0093252 | A1 * | 3/2023 | Draht | B22F 5/06 411/438 |

* cited by examiner

*Primary Examiner* — Long T Tran
*Assistant Examiner* — James J Kim
(74) *Attorney, Agent, or Firm* — Vivacqua Crane, PLLC

(57) ABSTRACT

An engine for a vehicle. The engine includes a cast engine block having a hybrid insert disposed in a fastener bore having rolled internal threads. The hybrid insert includes an internal surface having cut inner diameter (ID) threads and an external surface having rolled outer diameter (OD) threads. The rolled OD threads of the hybrid insert are received in the rolled internal threads of the fastener bore. The hybrid threaded insert may include a bi-metal in which the ID threads are formed of one metal alloy and the OD threads are formed of another metal alloy. Alternatively, the external surface of the hybrid insert may define locking features and the engine block is cast onto these locking features, thereby locking the hybrid insert to the engine block.

20 Claims, 6 Drawing Sheets

CAST ENGINE BLOCK HAVING A HYBRID THREADED INSERT

INTRODUCTION

The present disclosure relates to engine blocks for a vehicle, more particularly to a cast engine block having a threaded insert for receiving a treaded fastener.

A component of an internal combustion engine is the engine block, also referred to as a cylinder block. The cylinder block makes up the bottom-half of the internal combustion engine and is the main supporting structure that holds the majority of external engine accessories such as belt pulleys, water pumps, and alternators, as well as internal engine components such as crankshafts, and caps, also known as main caps, for retaining the crankshafts. These external engine accessories and the caps are fastened to the cylinder block with threaded fasteners such as bolts and studs.

A cylinder block is a casting manufactured from gray iron casting alloys or aluminum casting alloys. The cast cylinder block defines a plurality of bores having internal threads configured to receive a threaded fastener to attach the external engine accessories and the caps onto the cylinder block. The threaded bores are formed by drilling a hole into the cast cylinder block and forming the internal threads by tapping with a die. The internal threads are required to be sufficiently robust to retain the threaded fasteners under demanding operating conditions of the engine.

Thus, while cylinder blocks having threaded bores formed by the traditional method of drilling and tapping achieve their intended purpose, there is a continued need to increase the robustness of the internal threads of the fastener bores.

SUMMARY

According to several aspects, an engine for a vehicle is disclosed. The engine includes an engine block having a surface defining a fastener bore and a hybrid insert disposed in the fastener bore. The insert includes a cylindrical body having an internal surface defining inner diameter (ID) threads and an external surface defining a plurality of locking features. The ID threads are cut threads and the locking features include one or more of rolled threads, indentations, protrusions, splines, and textures.

In an additional aspect of the present disclosure, the engine block is cast onto the locking features so that the hybrid insert is locked into the engine block.

In another aspect of the present disclosure, the fastener bore of the engine block defines a plurality of inner diameter threads configured to receive the outer diameter (OD) threads of the hybrid insert. The inner diameter threads of the fastener bore of the engine block are rolled threads.

In another aspect of the present disclosure, the engine further include a cap having a through-hole. The engine block includes an interior surface defining a saddle having a shoulder on either side of the saddle. The through-hole of the cap is aligned with the fastener bore when the cap is assembled onto the shoulders of the saddle.

In another aspect of the present disclosure, the engine block comprises of a cast aluminum alloy and the cylindrical body of the hybrid insert includes an inner portion, or inner layer, having a first metal alloy and an outer portion, or outer layer, having a second metal alloy.

In another aspect of the present disclosure, the hybrid insert includes an annular end surface defining a notch for receiving a flat head tool.

In another aspect of the present disclosure, the hybrid insert is manufactured by additive manufacturing and includes a plurality of alloy compositions.

According to several aspects, an internal combustion (IC) engine is disclosed. The IC engine includes a cast engine block having an internal surface defining a saddle for receiving a rotatable shaft and at least one fastener bore adjacent the saddle. A hybrid insert is disposed in the at least one fastener bore. The hybrid insert includes an internal surface defining inner diameter (ID) threads for receiving a threaded fastener and an external surface having locking features fixed to the engine block. The ID threads are cut threads.

In an additional aspect of the present disclosure, the at least one fastener bore includes internal threads. The locking features of the external surface of the hybrid insert are rolled outer diameter (OD) threads mated to inner diameter rolled threads of the fastener bore, thereby fixing the hybrid insert to the engine block.

In another aspect of the present disclosure, in another embodiment, the locking features of the external surface of the hybrid insert includes at least one of an indentation, a protrusion, a spline, and a texture. The engine block is cast onto the locking features such that the hybrid insert is locked to the engine block.

In another aspect of the present disclosure, the hybrid insert includes an inner portion or layer having a first metal alloy and an outer portion or layer having a second metal alloy.

According to several aspects, a hybrid insert is disclosed. The hybrid insert includes a cylindrical body having an external surface defining locking features and an internal surface defining inner diameter (ID) threads, wherein the ID threads are cut threads.

In an additional aspect of the present disclosure, the locking features are outer diameter (OD) threads, wherein the OD threads are rolled threads.

In another aspect of the present disclosure, the locking features includes at least one of an indentation, a protrusion, a spline, and a texture.

In another aspect of the present disclosure, the hybrid insert further includes an end surface interconnecting the internal surface and the external surface. The end surface includes a notch operable to receive a flat edge surface of a tool.

In another aspect of the present disclosure, the cylindrical body includes an inner layer having a first metal alloy and an outer layer having a second metal alloy.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses. The illustrated embodiments are disclosed with reference to the drawings, wherein like numerals indicate corresponding parts throughout the several drawings. The figures are not necessarily to scale and some features may be exaggerated or minimized to show details of particular features. The specific structural and functional details disclosed are not intended to be interpreted as limiting, but as a representative basis for teaching one skilled in the art as to how to practice the disclosed concepts.

Figure 1:
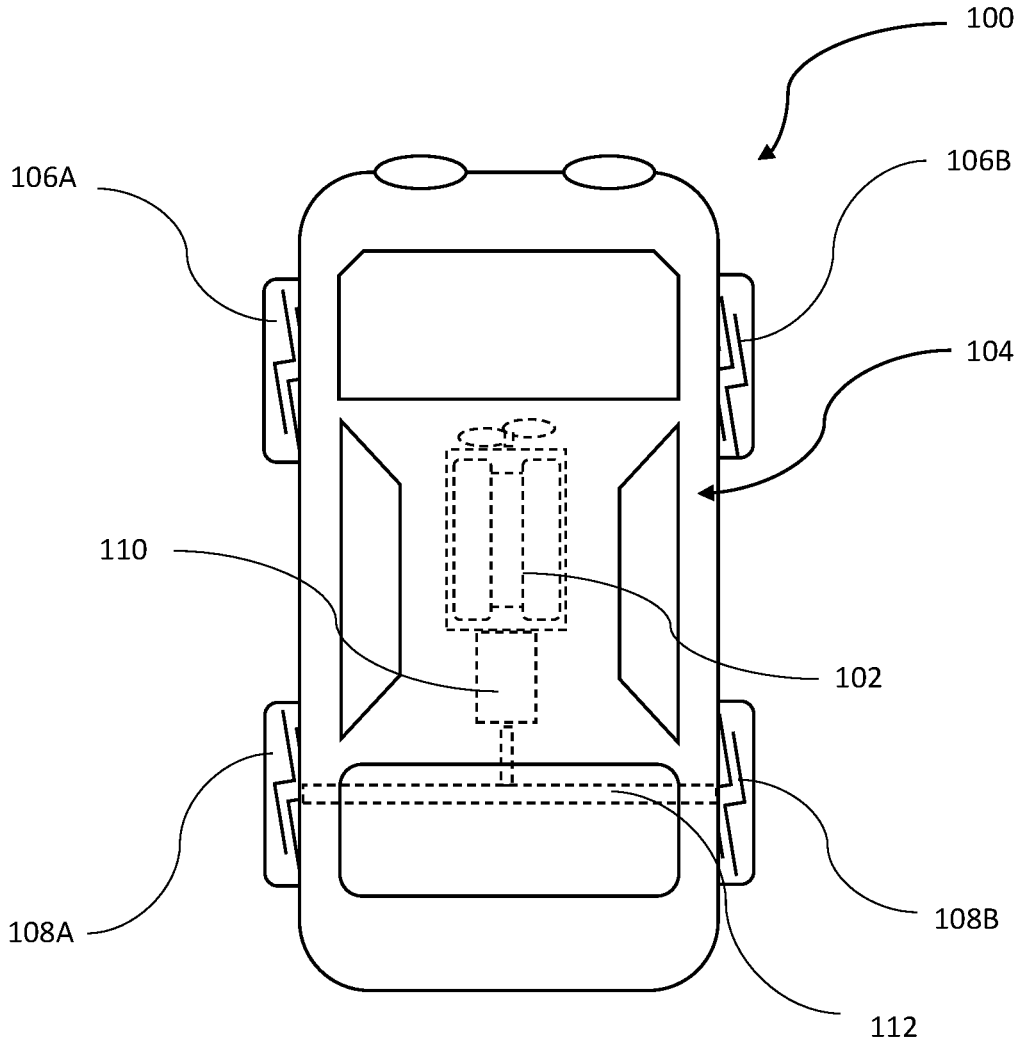
FIG. 1 is a diagram of a plan view of a vehicle having an internal combustion engine, according to an exemplary embodiment.

FIG. 1 is a diagrammatic illustration of a vehicle 100 having an internal combustion engine 102. The vehicle 100 generally includes a body 104 having front wheels 106A, 106B and rear wheels 108A, 108B. The front wheels 106A, 106B and the rear wheels 108A, 108B are each rotationally located near a respective corner of the body 104. The internal combustion engine 102 is mated to a transmission 110. The transmission 110 transmits torque output from the engine 102 to a series of mechanical linkages 112, which in turn deliver the torque to at least one of the wheels 106A, 1066, 108A, 108B for propelling the vehicle 100. While the vehicle 100 is depicted as a passenger car, other examples of vehicles include, but are not limited to, land vehicles such as motorcycles, trucks, sport utility vehicles (SUVs), and recreational vehicles (RVs), and non-land vehicles including marine vessels and aircrafts.

Figure 2:
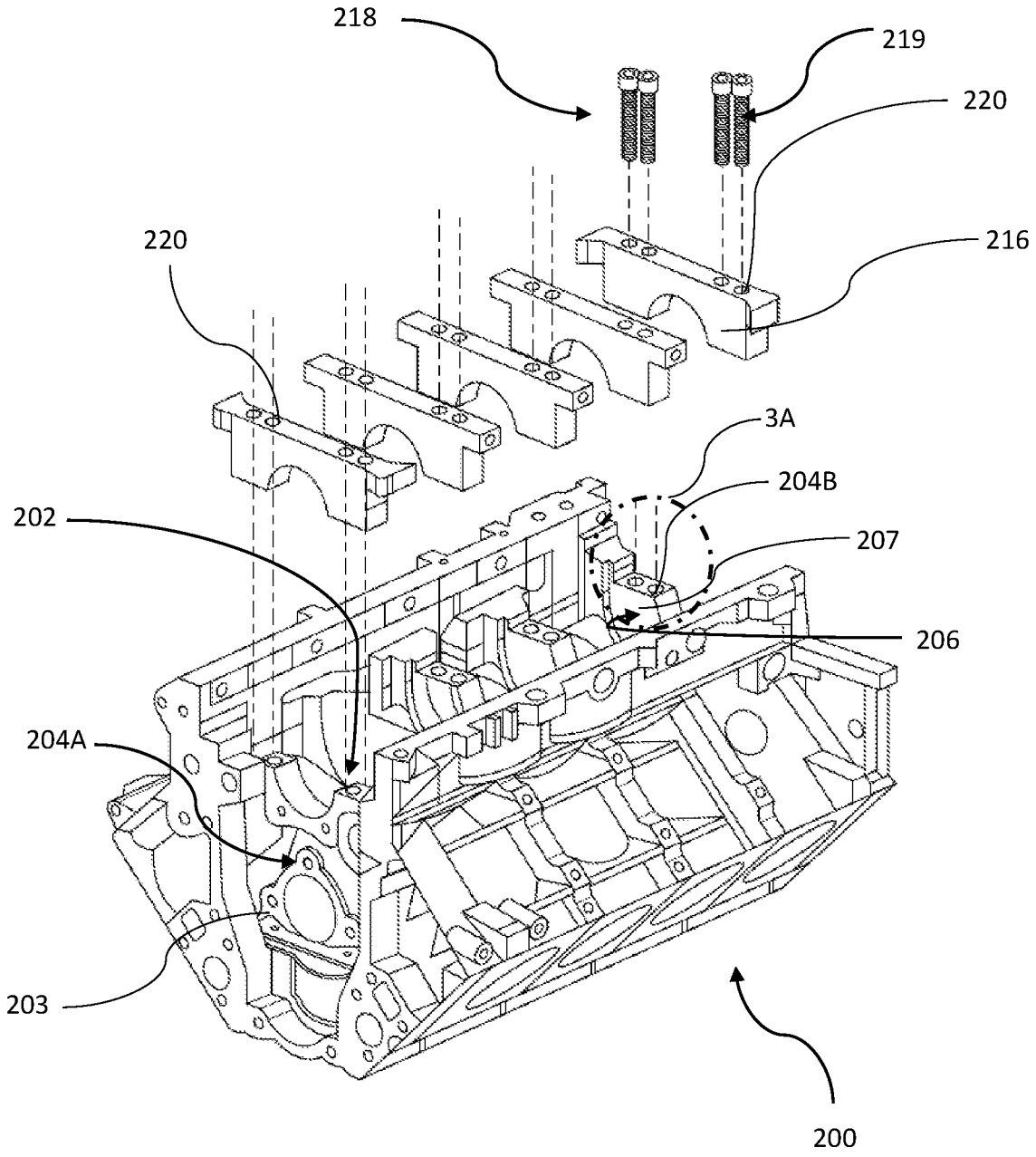
FIG. 2 is an illustration of a perspective view of a bottom end of an engine block, according to an exemplary embodiment.

FIG. 2 is an illustration of a non-limiting example of a perspective bottom view of a cylinder block 200 of a piston-type internal combustion engine 102. The cylinder block 200 makes up the bottom-half of the internal combustion engine 102 and is the main supporting structure that holds the majority of external engine components (not shown) such as belt pulleys, water pump, and alternator. The cylinder block 200 defines at least one cylinder bore 202 where a piston (not shown) moves in a reciprocating motion when fired with a combustible fuel. It should be understood that the engine 102 can be single cylinder engine, a multiple cylinder engine in a V configuration, an inline configuration, or an opposing cylinder bore configurations. The cylinder block 200 is a casting manufactured of gray casting iron alloys or aluminum casting alloys. Aluminum casting alloys are preferred due to weight savings for improved fuel economy.

The cylinder block 200 includes an exterior surface 203 defining a plurality of external fastener holes 204A for receiving a hybrid threaded insert 400, which is described in detail below, for the mounting of external engine components. The external fastener holes 204A are drilled and tapped to provide inner diameter threads 205, or referred to as internal threads 205, after the cast cylinder block 200 has solidified and ejected from the mold. Tapping includes cutting or by rolling the wall of the fastener holes 204A to form the internal threads. The fastener holes 204A may be through-holes extending completely through a portion of the cylinder block 200 or blind-holes extending partially through the portion of the cylinder block 200.

Figure 3:
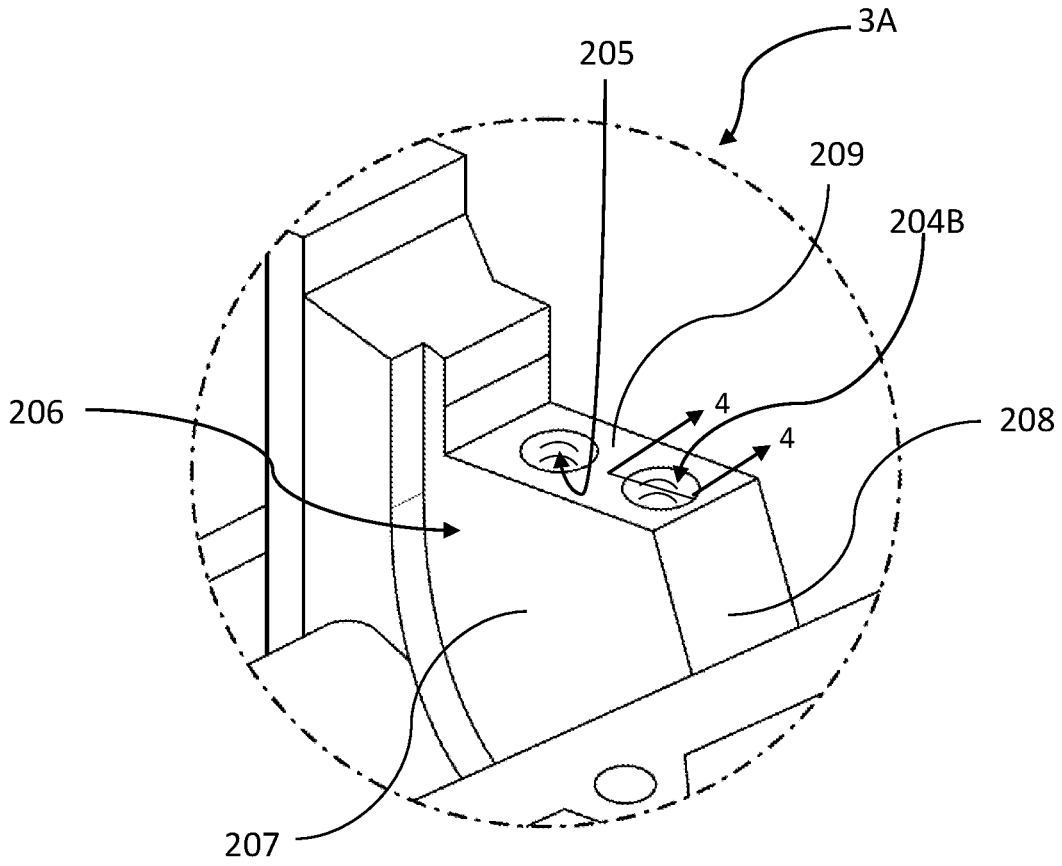
FIG. 3 is a detail view of a portion-3A of FIG. 2, according to an exemplary embodiment.

FIG. 3 is a detailed view of the portion 3A of the cylinder block 200 of FIG. 2. Referring to both FIGS. 2 and 3, the cylinder block 200 further includes an interior surface 206 defining a bulkhead 207 having a saddle 208 with a shoulder 209 on either side of the saddle 208. The saddle 208 is configured to receive a rotatable shaft (not shown) such as a crank shaft. The bulkhead 207 includes at least one internal fastener hole 204B on a shoulder 209 of the saddle 208. The at least one internal fastener hole 204B shown is a blind hole extending partially through the cylinder block 200. Similar to the external fastener hole 204A, the at least one internal fastener hole 204B is drilled and tapped to provide the ID threads 205.

Best shown in FIG. 2, the caps 216 are fastened to the cylinder block 200 with threaded fasteners 218 having external threads 219 such as threaded bolts and studs. At least one of the caps 216 includes a through-hole 220 that is in alignment with a corresponding threaded internal fastener hole 204B when the cap 216 is assembled onto the engine block 200. A threaded fastener 218 is inserted through the through-hole 220 of the cap 216 and into the internal threaded fastener hole 204B of the engine block 200 to retain the cap 216 onto the engine block 200. Therefore, the ID threads 205 defined in the fastener hole 204B of the cylinder block 200 are required to be sufficiently robust to retain the threaded fasteners 218 under engine load, engine vibrations, and repeated thermal cycles. The external fastener hole 204A and internal fastener hole 204B are similar in structure and therefore will be referred to interchangeably as a fastener hole 204 or fastener bore 204. In the example shown, the ID threads 205 of the fastener holes 204 are preferably formed by a rolling process to provide rolled ID threads 205 configured to receive a hybrid threaded insert 400, also referred to as hybrid insert 400.

Figure 4:
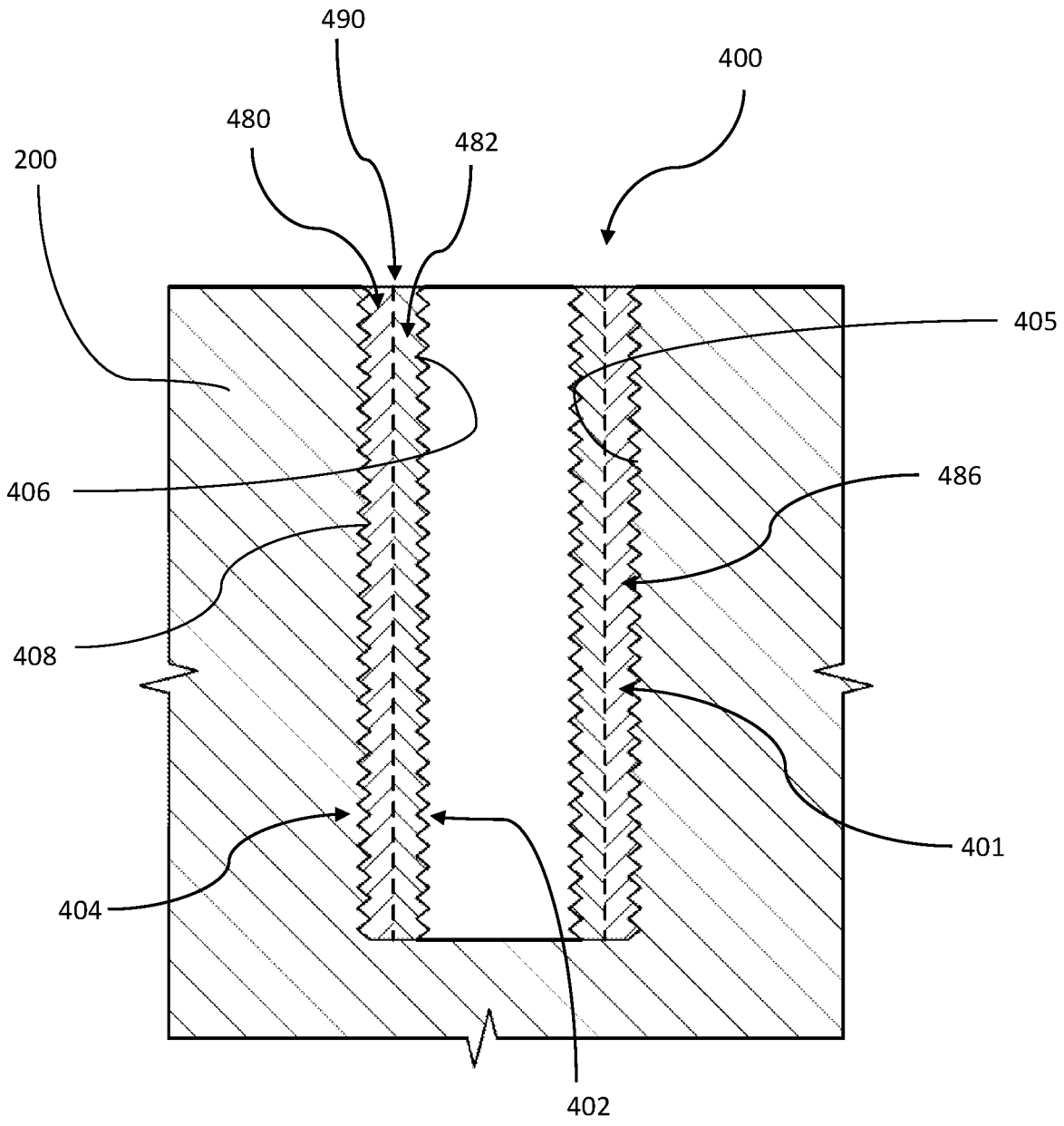
FIG. 4 is a cross-section view across line 4-4 of FIG. 3 showing a hybrid threaded insert, according to an exemplary embodiment.
Figure 5:
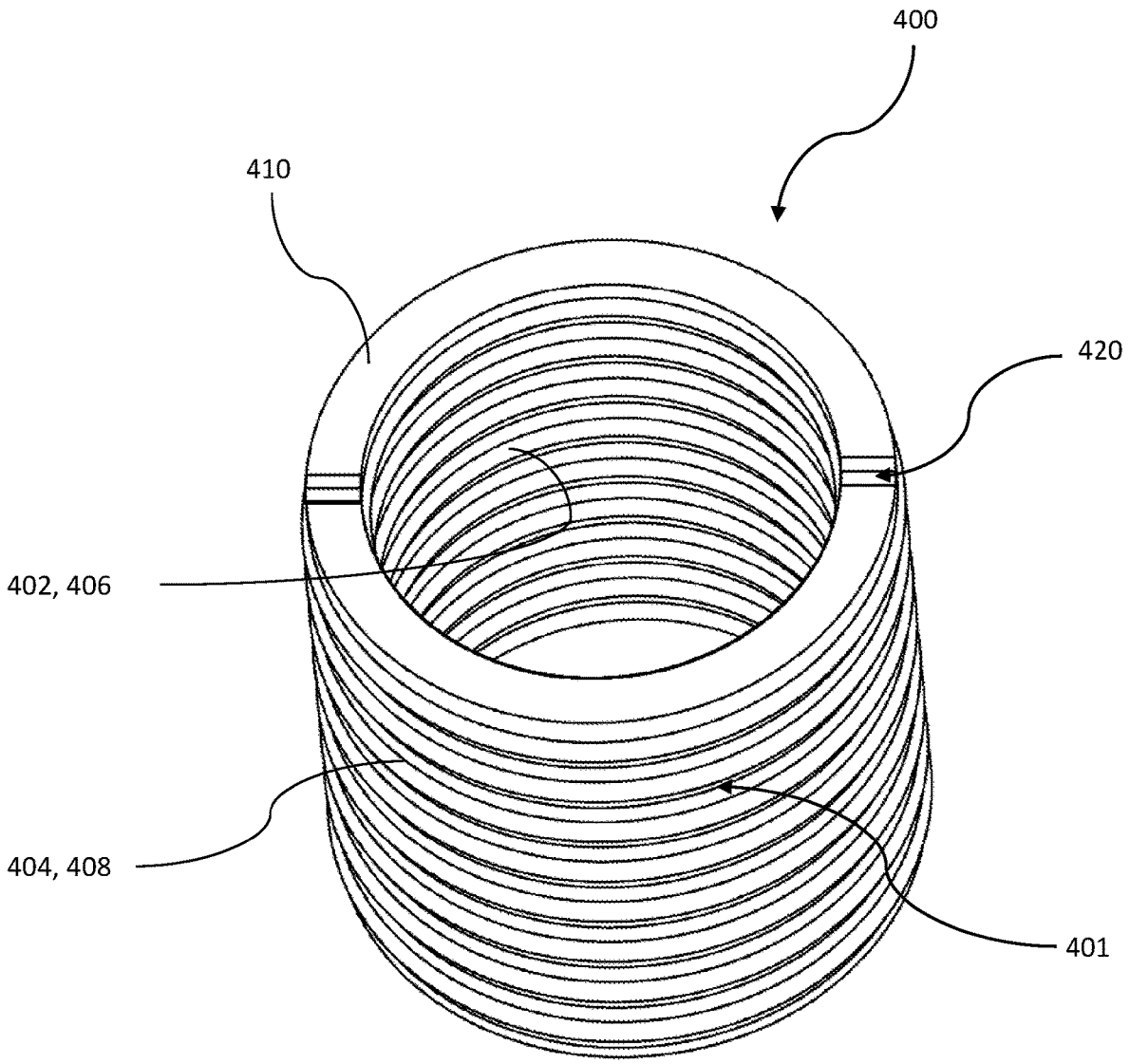
FIG. 5 is an illustration of a perspective view of the hybrid threaded insert, according to an exemplary embodiment.

FIG. 4 is a cross-sectional view of the at least one fastener hole 204 having the hybrid insert 400 along section line 4-4 of FIG. 3. FIG. 5 is a top perspective view of the hybrid insert 400. Referring to FIGS. 3-5, the hybrid threaded insert 400 includes a cylindrical body 401 having an internal surface 406 and an external surface 408 opposite the internal surface 406. The internal surface 406 defines a plurality of inner diameter (ID) threads 402 that are configured to receive and engage with the external diameter threads 219 of the threaded fastener 218. The ID threads 402 are cut threads in which the ID threads 402 are formed by severing the metal grain structure to define the ID threads 402.

The external surface 408 defines a plurality of outer diameter (OD) threads 404 that are configured be receivable into the threaded fastener holes 204 of the engine block 200. The OD threads 404 are rolled threads in which the OD threads 404 are formed by a cold forming process that uses a set of hardened steel dies to form the OD threads 404 onto an outer surface of a cylindrical metal workpiece. The die protrudes into the exterior surface of the cylindrical work piece to form the OD threads 404. As the cylindrical metal workpiece is rolled under high pressure, the steel grain flows in multiple directions, causing the OD threads 404 to be stronger, as it does not disturb the structural integrity of the metal. Rolled OD threads 404 are smoother in installation into the rolled internal threads 205 of the fastener holes 204 of the cylinder block 200 and more resistant to damage due to the OD threads 404 of the hybrid insert 400 being hardened and compressed by the rolling process.

The blank insert work piece may be made of high strength wrought aluminum alloy (e.g. 6061, 7000), a cast aluminum alloy (e.g. A206), or of a steel alloy. The blank insert work piece may be manufactured from an extruded tube with single high strength aluminum or bi-materials. Best shown in FIG. 4, the hybrid insert 400 includes an outer portion 480, or outer layer 480, having first metal alloy and an inner portion 482, or inner layer 482, having a second metal alloy. The outer portion 480 includes a cross-sectional area of the cylindrical body 486 between the external surface 408 and a mid-line 490. The inner portion 480 includes the cross-sectional area of the cylindrical body between the interior surface 406 and the mid-line 490. Alternatively, the hybrid insert 400 may be manufactured by an additive manufacturing (AM) process, such as 3-D printing, in which the metal composition may be tailored during the AM process.

FIG. 5 is an illustration of a perspective view of the hybrid threaded insert 400 having cut ID threads 402 and rolled OD threads 404. The hybrid insert 400 having cut ID threads 402 and rolled OD threads 404 provides a desirable combination of high fatigue resistance and low bolt load loss, which can simultaneously avoid thread failure as well as fretting fatigue. The hybrid insert 400 may be rotatably inserted into a drilled and tapped fastener hole 204 of the cylinder block 200. The hybrid insert 400 includes an annular end surface 410 connecting the internal surface 406 and the external surface 408. The end annular surface 410 defines at least one notch 420 for the insertion of a tool end, such as that of a large flat screwdriver, for rotatably inserting the hybrid insert 400 into the threaded fastener hole 204 of the cylinder block 200.

The configuration of cut ID threads 402 and rolled OD threads 404 provides residual compressive stress of greater than 100 megapascal (MPa) in the wall of hybrid insert 400 due to the rolling process on exterior surface, which will help in increasing fatigue strength. If cracks or fractures are initiate in the cut ID threads 402 during the normal operation of the engine 102, the cracks or fractures will not propagate due to the residual compressive stress. The rolled OD threads 404 engage with the rolled ID threads 205 of the cast aluminum block 200 and failure at this interface between the cast aluminum block 200 and hybrid insert 400 is also avoided due to the residual compressive stress.

Figure 6:
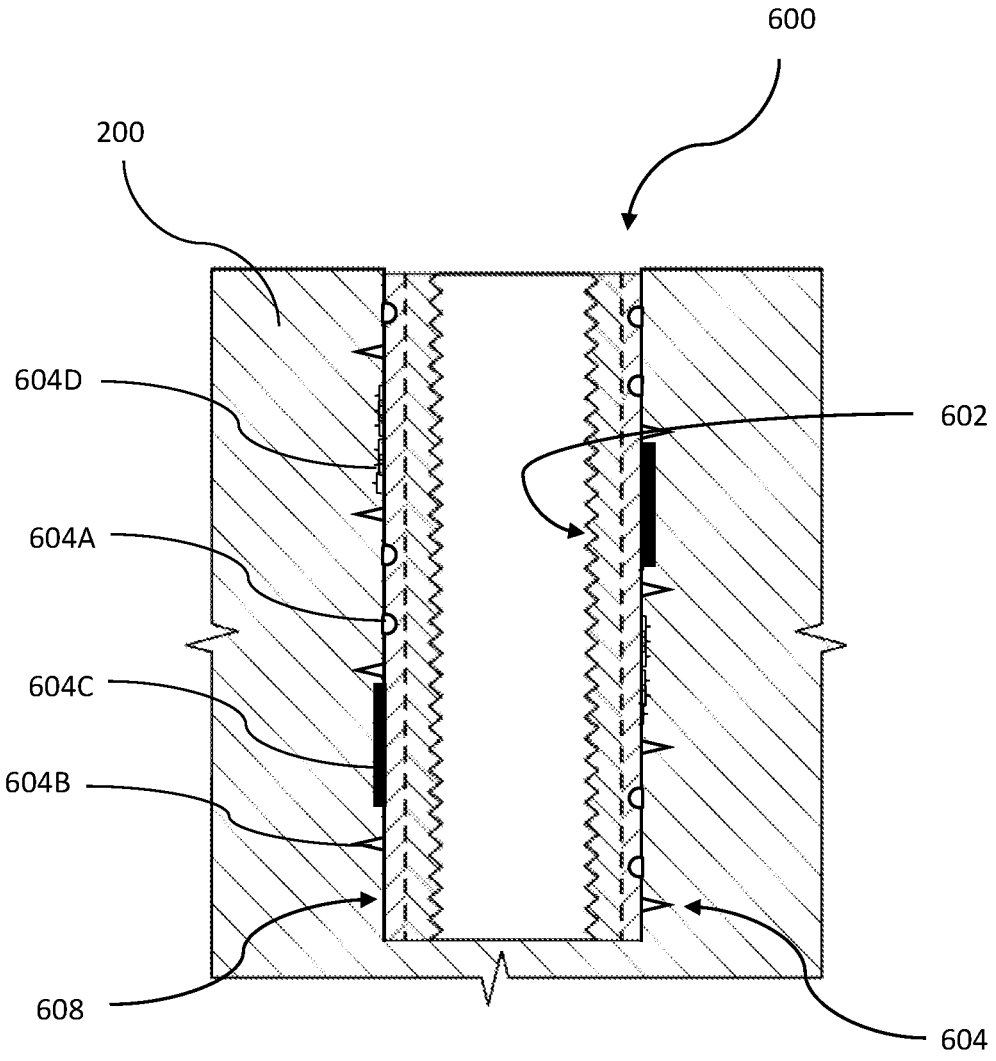
FIG. 6 is an illustration of cross-sectional view of an alternative embodiment of the hybrid threaded insert, according to another exemplary embodiment.

FIG. 6 is an alternative embodiment of a hybrid insert 600. In this embodiment, the hybrid insert 600 includes cut ID threads 602 and locking features 504 on the external surface 608. The locking features 604 includes at least one of an indentation 604A, a protrusion 604B, a spline 604C, and a textured surface 604D. In this embodiment, the cylinder block 200 is cast onto the hybrid insert 600 thereby encapsulating the external surface 608 of the hybrid insert 600. The locking features 604 aid in anchoring and locking the hybrid insert into the cylinder block 200.

The description of the present disclosure is merely exemplary in nature and variations that do not depart from the general sense of the present disclosure are intended to be within the scope of the present disclosure. Such variations are not to be regarded as a departure from the spirit and scope of the present disclosure.

What is claimed is:

1. An engine for a vehicle, comprising:

an engine block having a surface defining a fastener bore; and a hybrid insert disposed in the fastener bore, wherein the hybrid insert includes a cylindrical body having an internal surface defining inner diameter (ID) threads, wherein the ID threads are cut threads.

2. The engine of claim 1, wherein the cylindrical body further has an external surface defining a plurality of locking features including at least one of an indentation, a protrusion, a spline, and a texture; and the engine block is cast onto the locking features so that the hybrid insert is locked into the engine block.

3. The engine of claim 1, wherein the cylindrical body further has an external surface defining a plurality of outer diameter OD threads, and wherein the OD threads are rolled threads.

4. The engine of claim 3, wherein the fastener bore of the engine block defines a plurality of inner diameter threads configured to receive the OD threads of the hybrid insert.

5. The engine of claim 4, wherein the inner diameter threads of the fastener bore of the engine block are rolled threads.

6. The engine of claim 5, further including:

a cap having a through-hole;

wherein the engine block includes an interior surface defining a saddle having a shoulder on a side of the saddle;

wherein the fastener bore is located on the shoulder; and wherein the through-hole of the cap is aligned with the fastener bore when the cap is assembled onto the shoulder of the saddle.

7. The engine of claim 6, wherein the engine block comprises of a cast aluminum alloy.

8. The engine of claim 7, wherein the cylindrical body of the hybrid insert includes an inner portion having a first metal alloy and an outer portion having a second metal alloy.

9. The engine of claim 8, wherein the hybrid insert includes an annular end surface defining a notch for receiving a flat head tool.

10. The engine of claim 9, wherein the hybrid insert is manufactured by additive manufacturing and includes a plurality of alloy compositions.

11. An internal combustion engine comprising:

a cast engine block having an internal surface defining a saddle for receiving a rotatable shaft and at least one fastener bore on at least one side of the saddle; and a hybrid insert disposed in the at least one fastener bore, wherein the hybrid insert includes an internal surface defining inner diameter (ID) threads for receiving a threaded fastener and an external surface having locking features fixed to the cast engine block, wherein the ID threads are cut threads.

12. The engine of claim 11, wherein:

the at least one fastener bore includes inner diameter (ID) threads; and the locking features of the external surface of the hybrid insert are rolled outer diameter (OD) threads mated to the ID threads of the fastener bore, thereby fixing the hybrid insert to the cast engine block.

13. The engine of claim 12, wherein the ID threads of the at least one fastener bore are rolled threads.

14. The engine of claim 11, wherein the locking features of the external surface of the hybrid insert comprises at least one of an indentation, a protrusion, a spline, and a texture; and the cast engine block is cast onto the locking features such that the hybrid insert is locked to the cast engine block.

15. The engine of claim 13, wherein the hybrid insert includes an inner layer having a first metal alloy and an outer layer having a second metal alloy.

16. A hybrid insert comprising, a cylindrical body having an external surface defining locking features and an internal surface defining inner diameter (ID) threads, wherein the ID threads are cut threads.

17. The hybrid insert of claim 16, wherein the locking features are outer diameter (OD) threads, wherein the OD threads are rolled threads.

18. The hybrid insert of claim 16, wherein the locking features includes at least one of an indentation, a protrusion, a spline, and a texture.

19. The hybrid insert of claim 17, further includes an end surface interconnecting the internal surface and the external surface, wherein the end surface includes a notch operable to receive a flat edge surface of a tool.

20. The hybrid insert of claim 16, wherein the cylindrical body includes an inner layer having a first metal alloy and an outer layer having a second metal alloy.

* * * * *